United States Patent [19]

Thornthwaite et al.

[11] Patent Number: 4,807,583

[45] Date of Patent: Feb. 28, 1989

[54] FUEL PUMPING APPARATUS

[75] Inventors: Ian R. Thornthwaite, Gillingham; Robin E. Wardley, Sittingbourne, both of England

[73] Assignee: Lucas Industries Public Limited Company, Birmingham, England

[21] Appl. No.: 57,373

[22] Filed: Jun. 2, 1987

[30] Foreign Application Priority Data

Jun. 4, 1986 [GB] United Kingdom ..... 8613465

[51] Int. Cl.[4] ..... E02M 67/00

[52] U.S. Cl. ..... 123/516; 123/198 D; 123/198 DB; 123/510; 123/514

[58] Field of Search ..... 123/179 L, 198 D, 198 DB, 123/510, 514, 516

[56] References Cited

U.S. PATENT DOCUMENTS

| | | | |
|---|---|---|---|
| 4,319,550 | 3/1982 | Ishii et al. | 123/198 D |
| 4,370,967 | 2/1983 | Gmelin et al. | 123/516 |
| 4,546,745 | 10/1985 | Brotherston | 123/198 D |
| 4,602,605 | 7/1986 | Adkins | 123/516 |

FOREIGN PATENT DOCUMENTS

| | | | |
|---|---|---|---|
| 53-41630 | 4/1978 | Japan | 123/516 |
| 58-85357 | 5/1983 | Japan | 123/516 |
| 58-197460 | 11/1983 | Japan | 123/198 D |

*Primary Examiner*—Tony M. Argenbright
*Assistant Examiner*—Eric R. Carlberg
*Attorney, Agent, or Firm*—Balogh, Osann, Kramer, Dvorak, Genova & Traub

[57] ABSTRACT

A fuel pumping apparatus for supplying fuel to a compression ignition engine includes a high pressure pump to which fuel is supplied by a low pressure pump by way of a throttle which is responsive to the output pressure of the low pressure pump for the purpose of providing a governing action. A valve is connected in series with the pumps and is energized to the open position through a pressure responsive switch which closes when the output pressure of the low pressure pump is above a predetermined value. Means is provided to energize the valve for the purpose of starting the associated engine.

14 Claims, 1 Drawing Sheet

FUEL PUMPING APPARATUS

This invention relates to a fuel pumping apparatus for supplying fuel to a compression ignition engine and of the kind comprising a high pressure pump which in use is actuated in timed relationship with the associated engine and an engine driven low pressure pump for supplying fuel under pressure to the high pressure pump, the apparatus further including liquid pressure operable means for controlling the quantity of fuel delivered by the high pressure pump, said low pressure pump constituting the source of liquid under pressure for said pressure operable means.

One example of such an apparatus is a distributor type fuel pump in which the flow of fuel to the high pressure pump from the low pressure pump is controlled by a throttle member which is subjected to the outlet pressure of the low pressure pump and is movable against the action of a spring to reduce the fuel flow to the high pressure pump and therefore to the engine, as the engine speed increases. The force exerted by the spring can be adjusted manually and a governing action is obtained since as the engine speed decreases, so also will the outlet pressure of the low pressure pump causing the pressure operable means to move to increase the amount of fuel supplied to the engine and vice versa.

Another example of an apparatus of the aforesaid kind is described in British Published Specification No. 2037365A and in which the distributor member is movable axially against the action of a spring to reduce the fuel flow to the engine by means of fuel under pressure derived from the low pressure pump, the fuel pressure applied to the distributor member being adjusted by means of an electronic control system.

A further example of an apparatus having an axially movable distributor member is described in British Published Specification No. 2069722A. In this example the pressure applied to the distributor member is controlled by a mechanical governor mechanism.

In each form of apparatus outlined above in the event that the output pressure of the low pressure pump falls due for example to air being drawn into the low pressure pump, there will be a tendency for the quantity of fuel supplied to the engine to increase. This is because although the pressure of fuel delivered by the low pressure pump may fall, it may not fall sufficiently to reduce the flow of fuel to the high pressure pump. In any case, the high pressure pump itself can draw fuel through its supply channel particularly as the engine speed increases. The effect is that the governing action may be lost.

The object of the present invention is to provide an apparatus of the aforesaid kind as set out in the first paragraph, in a simple and convenient form.

According to the invention an apparatus of the kind specified comprises electromagnetic valve means which when energized allows fuel flow to the associated engine, a pressure responsive device which is responsive to the pressure of fuel developed by the low pressure pump and which when the fuel pressure is above a predetermined value acts to maintain said valve means energized, and means for energizing said valve means to allow starting of the associated engine.

An example of a fuel pumping apparatus in accordance with the invention will now be described with reference to the accompanying drawings in which.

Figure 1:
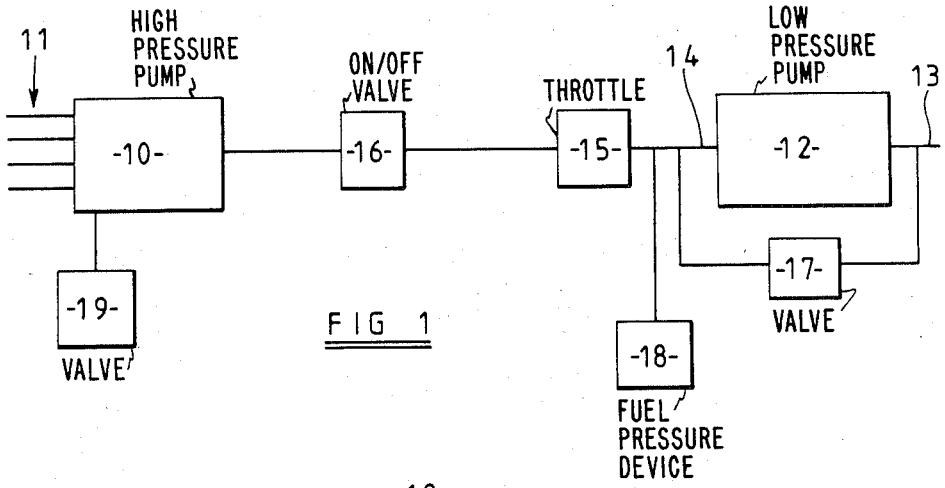
FIG. 1 is a diagrammatic layout of the pumping apparatus.

Referring to FIG. 1 of the drawings the apparatus comprises a high pressure pump 10 having a plurality of outlets 11 for connection in use to the injection nozzles respectively of the associated engine. The high pressure pump 10 is driven in timed relationship with the associated engine and it is supplied with fuel by a low pressure pump 12 which is also driven by the engine. The inlet 13 of the low pressure pump is connected to a source of fuel such for example as a fuel tank and the outlet 14 of the low pressure pump is connected by way of a throttle 15 and an on/off valve 16 to the inlet of the high pressure pump. The inlet and outlet of the low pressure pump are interconnected by a pressure regulating valve 17 which acts to control the outlet pressure of the low pressure pump so that it varies in accordance with the speed at which the apparatus is driven.

In operation, with the valve 16 in the open position, fuel is supplied by the low pressure pump to the high pressure pump which in turn supplies fuel to the combustion chambers of the associated engine. The quantity of fuel is determined by the setting of the throttle 15 which comprises a throttle member which is movable axially against the action of a governor spring, by means of the fuel pressure at the outlet 14 of the low pressure pump. The throttle is arranged so that as it is moved further against the action of the spring with increasing fuel pressure, the quantity of fuel which is supplied to the high pressure pump and hence to the associated engine, is decreased. The force exerted by the spring is adjustable by manually operable means and the arrangement provides a speed governing action.

As explained it is possible for air to enter the inlet 13 of the low pressure pump to cause a reduction in the outlet pressure and by virtue of the disposition of the throttle, this can respond to the reduction of pressure to allow more fuel to flow to the associated engine. The governing action is therefore lost and this can lead to a dangerous situation particularly if the engine is driving a road vehicle.

In order to overcome the aforesaid problem a fuel pressure responsive device 18 is provided which is responsive to the pressure at the outlet 14 of the low pressure pump. The device 18 controls the energization of the valve 16 and it is arranged that when the outlet pressure falls below a predetermined value, the valve 16 is moved to the closed position thereby preventing further supply of fuel to the associated engine.

The valve 16 can be replaced by a valve 19 which when closed, allows fuel flow to the associated engine but which when open, causes the fuel which is pumped by the high pressure pump, to flow to a drain thereby preventing the supply of fuel to the associated engine.

The valves 16 and 19 are electromagnetically controlled and it is arranged that the valves have to be energized when it is required to supply fuel to the associated engine. In this manner the valves can also serve to stop the engine when so required. The pressure responsive device 18 can be connected electrically in series with the valves 16 or 19, the device 18 being in the form of a switch which is arranged to be closed when the pressure is above a predetermined value. With this arrangement however there occurs a problem when trying to start the engine since the output pressure of the low pressure pump will be below the aforesaid predetermined value. It is necessary therefore to provide some sort of temporary supply circuit to the valves when starting the associated engine.

Figure 2:
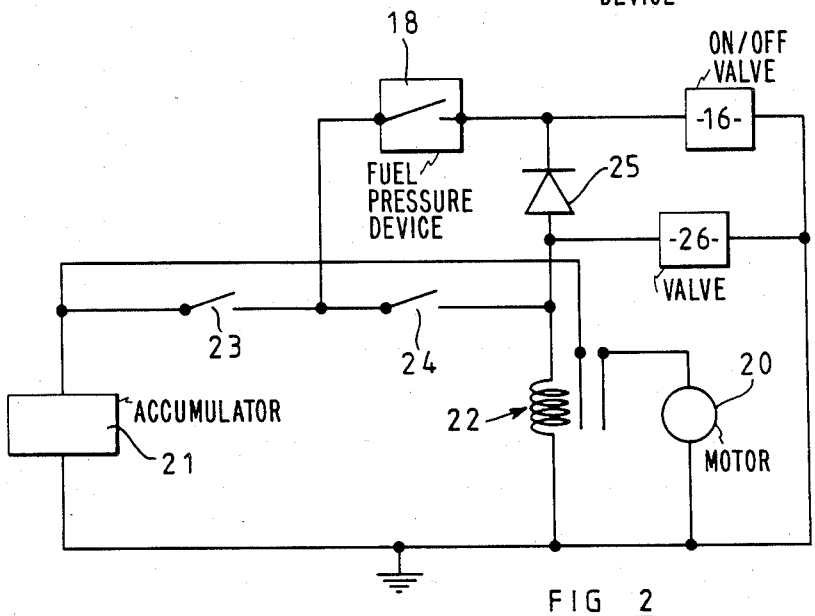
FIG. 2 is an electrical circuit diagram for use with the apparatus shown in FIG. 1.

Referring now to FIG. 2 of the drawings, the engine starting motor is shown at 20 and has one of its supply terminals connected to earth and to one terminal of the storage accumulator 21. The other terminal of the motor can be connected to the other terminal of the storage accumulator by way of a relay 22 having a winding which is energized when switches 23 and 24 are closed. Switch 23 is the conventional key switch of the vehicle electrical system and which is closed when it is required to run the vehicle, the switch also serving to control the supply of power to various vehicles accessories. The switch 24 is a switch which is closed usually by turning the key switch beyond its normal position to an engine start position. When the switches 23 and 24 are closed, the relay 22 is energized causing operation of the starting motor of the engine. A point intermediate the switches 23, 24 is connected to the valve 16 by way of the sensor 18 which in this example is a simple pressure operated switch. In normal running of the engine therefore the switch 23 will be closed, the switch 24 opened and the switch constituted by the sensor 18 closed so that the valve 16 will be energized to allow fuel flow.

For starting purposes a diode 25 is provided which upon closure of the switch 24 provides a supply to the valve 16 to energize the valve so long as the starter motor is in operation. Once the engine has started the switch constituted by the sensor 18 will be closed and the engine can run normally with the switch 24 opened. The diode acts to prevent energization of the relay 22 once the switch 24 has been opened. When it is required to stop the engine, the switch 23 is opened and this deenergizes the valve 16 to prevent further supply of fuel to the high pressure pump and therefore to the associated engine.

In the case of the pumps described in British Published Specification Nos. 2037365A and 2069722A the throttle 15 is replaced by a pressure control system which controls the pressure applied to the end of the distributor member of the apparatus. In this case the valve 16 is connected directly to the outlet 14 of the low pressure pump so that when the valve 16 is deenergized the supply of fuel to the associated engine is prevented.

In both forms of apparatus described it is sometimes necessary to purge air from the passages within the apparatus and particularly those of the high pressure pump to facilitate rapid restarting of the engine.

In order to achieve this a further valve 26 is provided and as shown in FIG. 2 this is connected in parallel with the relay 22 so that it will be energized when the starting motor of the associated engine is in operation. The valve 26 when energized, assumes an open position and it is arranged so that it communicates with the pumping chamber of the high pressure pump during the filling periods thereof. This is achieved using suitable porting on the distributor member and in the surrounding body. In this manner during a filling period of the high pressure pump the valve 26 provides a flow path to drain facilitating the purging of air from the passages within the apparatus. The flow path through the valve 26 must be such as to restrict the flow of fuel but allow substantially free flow of air otherwise the pumping chamber of the high pressure pump would not fill with fuel.

Alternatively the valve 26 and the porting may be arranged to allow air and fuel to escape to drain during the initial portion only of a delivery stroke of the high pressure pump.

We claim:

1. A fuel pumping apparatus for supplying fuel to a compression ignition engine comprising a high pressure pump which in use is actuated in timed relationship with an associated engine and an engine driven low pressure pump for supplying fuel under pressure to the high pressure pump, valve means for controlling the outward pressure of said low pressure pump so that the pressure varies in accordance with the speed of said associated engine, the apparatus further including liquid pressure operable means for varying the quantity of fuel delivered by the high pressure pump, said low pressure pump constituting the source of liquid under pressure for said pressure operable means, electromagnetic valve means which when energized controls fuel flow to the associated engine, a pressure responsive device which is responsive to the pressure of fuel developed by the low pressure pump and which, when the fuel pressure is above a predetermined value, acts to maintain said electromagnetic valve means energized, and means for energizing said electromagnetic valve means to allow starting of the associated engine.

2. An apparatus according to claim 1 in which the means for energizing said electromagnetic valve means comprises a switch which is closed to achieve operation of the starting motor of the associated engine.

3. An apparatus according to claim 2 including a diode connected in series with said switch and said electromagnetic valve means, said diode acting to prevent the supply of electric current to other electrical components when said switch is opened following starting of the engine.

4. An apparatus according to claim 1 including further valve means operating during starting of the associated engine, to allow air to escape from the high pressure pump.

5. An apparatus as claimed in claim 1 in which said electromagnetic valve means is connected in series between the high pressure pump and the low pressure pump.

6. An apparatus as claimed in claim 1 in which said electromagnetic valve means is associated with the high pressure pump and which when opened, diverts fuel pumped by the high pressure to a drain.

7. An apparatus according to claim 2, including further valve means operating during starting of the associated engine, to allow air to escape from the high pressure pump.

8. An apparatus according to claim 3, including further valve means operating during starting of the associated engine, to allow air to escape from the high pressure pump.

9. An apparatus as claimed in claim 2, in which said electromagnetic valve means is connected in series between the high pressure pump and the low pressure pump.

10. An apparatus as claimed in claim 3, in which said electromagnetic valve means is connected in series between the high pressure pump and the low pressure pump.

11. An apparatus as claimed in claim 4, in which said electromagnetic valve means is connected in series between the high pressure pump and the low pressure pump.

12. An apparatus as claimed in claim 2, in which said electromagnetic valve means is associated with the high pressure pump and which when opened, diverts fuel pumped by the high pressure pump to a drain.

13. An apparatus as claimed in claim 3, in which said electromagnetic valve means is associated with the high pressure pump and which when opened, diverts fuel pumped by the high pressure to a drain.

14. An apparatus as claimed in claim 4, in which said electromagnetic valve means is associated with the high pressure pump and which when opened, diverts fuel pumped by the high pressure to a drain.

* * * * *